US006257189B1

(12) United States Patent
Moretz et al.

(10) Patent No.: US 6,257,189 B1
(45) Date of Patent: Jul. 10, 2001

(54) VALVE GUIDE

(75) Inventors: Ralph D. Moretz; Mark A. Herioux, both of Jackson, MI (US)

(73) Assignee: TMJ Properties, L.L.C., Jackson, MI (US)

( * ) Notice: Subject to any disclaimer, the term of this patent is extended or adjusted under 35 U.S.C. 154(b) by 0 days.

(21) Appl. No.: 09/597,664

(22) Filed: Jun. 21, 2000

(51) Int. Cl.[7] ..... F01L 1/46
(52) U.S. Cl. ..... 123/90.5; 123/90.51
(58) Field of Search ..... 123/90.42, 90.48, 123/90.5, 90.51

(56) References Cited

U.S. PATENT DOCUMENTS 4,207,775 * 6/1980 Lintott ..... 74/55
4,765,290 * 8/1988 Tanaka ..... 123/90.42
5,022,356 * 6/1991 Morel, Jr. et al. ..... 123/90.5
5,088,455 2/1992 Moretz .

* cited by examiner

*Primary Examiner*—Weilun Lo
(74) *Attorney, Agent, or Firm*—Young & Basile, P.C.

(57) ABSTRACT

A valve lifter guide for internal combustion engines for preventing rotation of the valve lifters. The guide consists of an elongated support which is affixed to an internal combustion engine block, and spaced resilient cantilever supported fingers extending from the support have a free end which engages an orientation flat surface on the valve lifter and prevents valve lifter rotation. The resiliency of the fingers simplifies installation of the guide and assures engagement of the guide fingers with the lifter flat surface. An embodiment includes alignment features to facilitate assembly of the valve push rods.

8 Claims, 3 Drawing Sheets

10
12
14
16
18
20
22
24
26

10
12
14
16
18
20
22
24

10
12
14
16
20
22
24
26

12
16
20
24
26

VALVE GUIDE

BACKGROUND OF THE INVENTION

1. Field of the Invention

The invention pertains to guides for roller valve lifters for internal combustion engines to prevent rotation of the valve lifter about its axis.

2. Description of the Related Art

Valve lifters for internal combustion engines reciprocate within the engine block and through a lifter rod operate the intake and exhaust valves. The lower end of roller valve lifters includes a roller which engages a lobe upon the engine camshaft. By using a roller at the lower end of the valve lifter, friction between the lifter and camshaft is reduced providing superior engine performance. However, the lifter roller must rotate about an axis parallel to the axis of rotation of the camshaft and guide means must be used to properly maintain the orientation of the valve lifter in this respect.

Orientation of roller valve lifters to the camshaft is usually accomplished by forming a flat orientation surface on the valve lifter which is oriented to the axis of the valve lifter roller and cooperates with a guide engaging the lifter orientation surface to prevent rotation of the valve lifter about its axis. Usually, two parallel flat surfaces are defined upon each lifter located upon opposite sides of the lifter axis.

In the past, valve lifter guides for internal combustion engines to prevent valve lifter rotation have been formed of metal and include flats which correspond to the configuration of the lifter flats. The lifter reciprocates within the guide openings and the relationship between the guide openings and lifter flats prevents valve lifter rotation. The metal-to-metal contact between the valve lifters require clearances and the guides produce wear which increases the clearances between the moving parts, and excessive noise may be generated and improper cam lobe tracking can occur. Further, conventional metal valve lifter guides are relatively heavy, expensive to manufacture and assemble within the engine, and are prone to improper assembly if care is not taken.

Many of the aforementioned shortcomings of internal combustion engine valve lifter guides have been overcome by the applicants' roller valve guide shown in U.S. Pat. No. 5,088,455. The lifter guide shown in this patent is preferably formed of synthetic self-lubricating material and is inexpensive to manufacture, long wearing and easy to install. However, the valve lifter guide shown in U.S. Pat. No. 5,088,455 is of such a construction as to accommodate only certain types of internal combustion engines, and cannot readily be used with some types of V-block or straight engines.

OBJECTS OF THE INVENTION

It is an object of the invention to provide a low cost effective anti-rotation guide for internal combustion engine valve lifters which may be readily used with V-block engines, and may readily be designed to accommodate various sizes of engines, even those in which the valve lifter bores are not centered upon a common centerline, and/or the lifters operate at differing angles relative to the engine block face.

Another object of the invention is to provide an anti-rotation valve lifter guide using a plurality of resilient fingers for engaging the valve lifter and preventing rotation thereof, the resiliency of the fingers insuring an effective engagement between the guide and the valve lifters.

Yet another object of the invention is to provide a versatile anti-rotation valve lifter guide utilizing resilient cantilever mounted fingers and wherein a valve push rod guide is mounted upon the fingers having alignment means to facilitate push rod assembly with the valve lifters.

SUMMARY OF THE INVENTION

The valve lifter guide of the invention can be formed of any material, including a polymer, stamped metal, ceramic or any material capable of being formed in the desired configuration. The guide must have a limited degree of resiliency, and from a cost and manufacturing standpoint, molding the valve lifter guide from a synthetic polymer is desirable.

The valve lifters in a V-block internal combustion engine are located within cylindrical guide bores obliquely related to the vertical. Half of the lifters are located on one side of the engine longitudinal axis, while the other half of the lifters are on the other side of the engine axis. A valve lifter guide in accord with the invention is associated with the valve lifters on both sides or banks of the engine and it is only necessary to install a single guide for association with all of the valve lifters used in a V-block engine arrangement.

The valve lifters with which the guide of the invention is used are of cylindrical configuration having a roller located at the lower end for engagement with the engine camshaft. At the upper end of the valve lifters, one or a pair of spaced parallel flat orientation surfaces are defined in diametrically opposed relationship, and one of these flat orientation surfaces is engaged by the guide along a linear line of engagement to prevent rotation of the valve lifter about its longitudinal axis. The upper end of the valve lifters are engaged by valve push rods which operate the engine's inlet and exhaust valves by a rocker arm assembly.

The valve lifter guide includes a central body of an elongated form having parallel lateral sides. The body includes engine attachment means, such as holes for receiving bolts or other mounting structure, whereby the guide may be firmly affixed to the engine block at a central location and the length of the guide body is parallel to the engine length.

A plurality of resilient cantilever supported fingers extend from each of the guide body lateral edges. These fingers are relatively stiff, but capable of limited resilient deflection relative to the body. The fingers are spaced from each other along the associated body lateral edge, and the length of adjacent fingers will normally be different in order to accommodate the location of the engaged valve lifter with which the finger is associated.

The outer end of each of the guide fingers is formed with a linear surface for engaging a flat valve lifter orientation surface. It is this linear engagement of the outer end of a finger with a valve lifter flat surface which prevents rotation of the valve lifter about its axis.

In the preferred embodiment of the invention, the finger valve lifter linear engaging surface is defined by forming the outer end of the guide fingers with a convex surface created by shaping the finger ends of a J-configuration wherein the end of the fingers extends away from the engine block. The convex surface defined by the J-configuration extends the width of the fingers defining a linear line of contact with the valve lifter flat orientation surface, and also, the length of the fingers is such that the finger ends will simultaneously engage the surface of the engine adjacent the guide bores in which the valve lifters are received. The resilient nature of the fingers permits this dual engagement of the fingers with the valve lifter and the engine block and, of course, the length of the fingers is accurately controlled during manufacture to permit this dual engagement of the finger ends.

As the convex J-configurations formed on the finger ends have a length parallel to the central valve guide body, and, in most cases, are of a width equal to the finger width, the resultant linear line of contact between the finger ends and the valve lifter flat guide surfaces effectively prevents rotation of the valve lifters.

In a variation of valve lifter guide utilizing the concepts of the invention, the ends of the fingers are formed with a flat surface which directly engages the valve lifter flat orientation surface. Additionally, aprons are defined on the end of the guide fingers extending from the fingers' flat surface whereby a valve lifter rod guide may be formed on each finger end to facilitate the assembly of valve lifter rods with the valve lifter ends. The valve lifter guides include an opening for receiving the valve lifter rods, and alignment structure, such as oblique surfaces, are defined on the rod guides adjacent the openings to facilitate insertion of the valve rods therethrough.

A valve lifter guide constructed in accord with the invention may be economically manufactured, is low cost, and effectively prevents valve lifter rotation.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENTS

Figure 1:
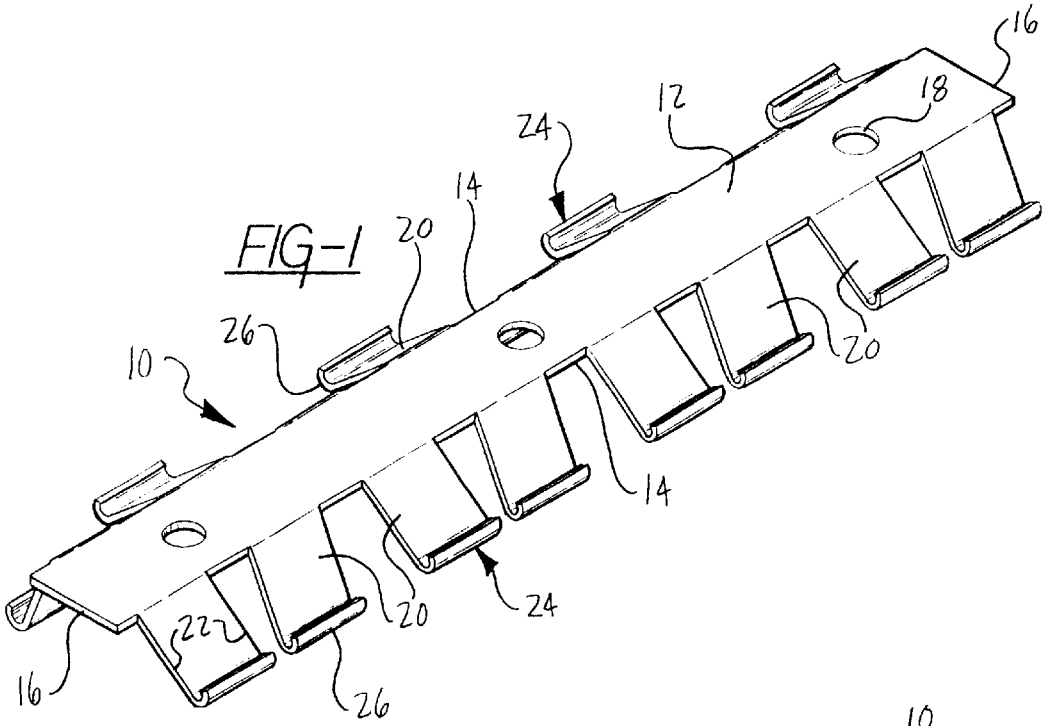
FIG. 1 is a perspective view of a valve lifter guide utilizing the concepts of the invention.
Figure 2:
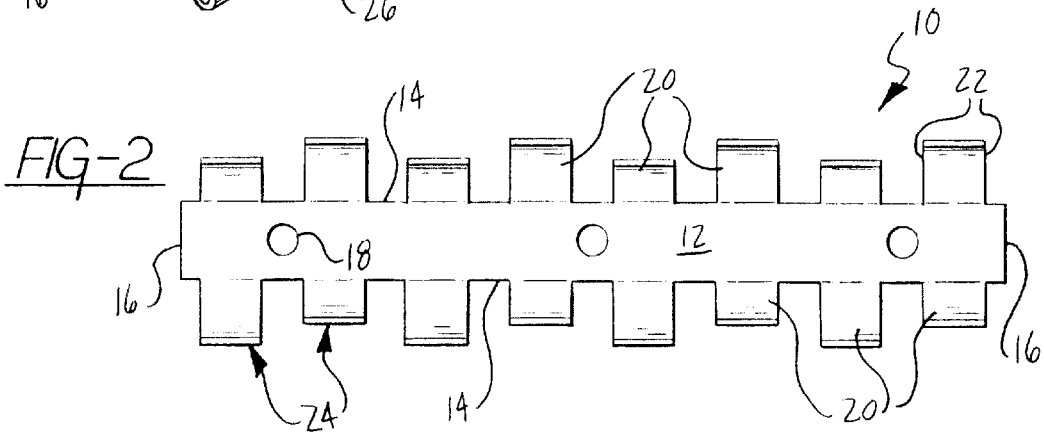
FIG. 2 is a top plan view of the guide of FIG. 1.
Figure 3:
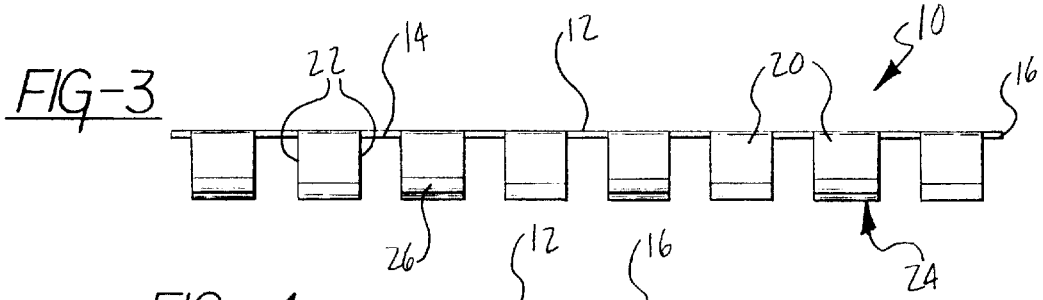
FIG. 3 is a side elevational view of the lifter guide as taken from the bottom of FIG. 2.

The embodiment of a valve lifter guide in accord with the invention which is of the simplest construction is shown in FIGS. 1–5. With reference to FIG. 1, the valve lifter guide is generally indicated at 10. The guide 10 includes an elongated central body 12 of a thin plate type configuration having parallel lateral sides 14, and the length of the body 12 is defined by ends 16. Holes 18 are formed in the body 12 to permit the valve lifter guide to be mounted upon an internal combustion engine as later described.

A plurality of resilient cantilever supported fingers 20 homogeneously extend from the body lateral sides 14. As will be appreciated from FIGS. 1–3, the width of the fingers 20 are defined by the parallel finger edges 22, and the end of each finger is defined by a free end 24. As will be appreciated from FIG. 2, the length of alternate fingers defined upon a common body lateral side 14 varies. This difference in the length of the fingers is to accommodate the differences of the location and orientation of the valve lifter bores and valve lifters on the engine block as will be apparent from FIG. 5.

Figure 4:
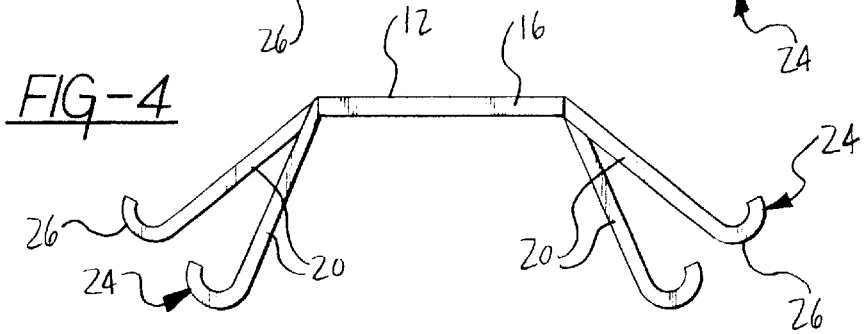
FIG. 4 is an end elevational view of the valve lifter guide.

The free end 24 of the fingers 20 is of a J-configuration, FIG. 4, defining an outer convex surface 26 which is substantially cylindrical in configuration. The convex surface 26 is uniform in configuration throughout the width of the associated finger between edges 22 of a common finger as appreciated from FIG. 1.

Figure 5:
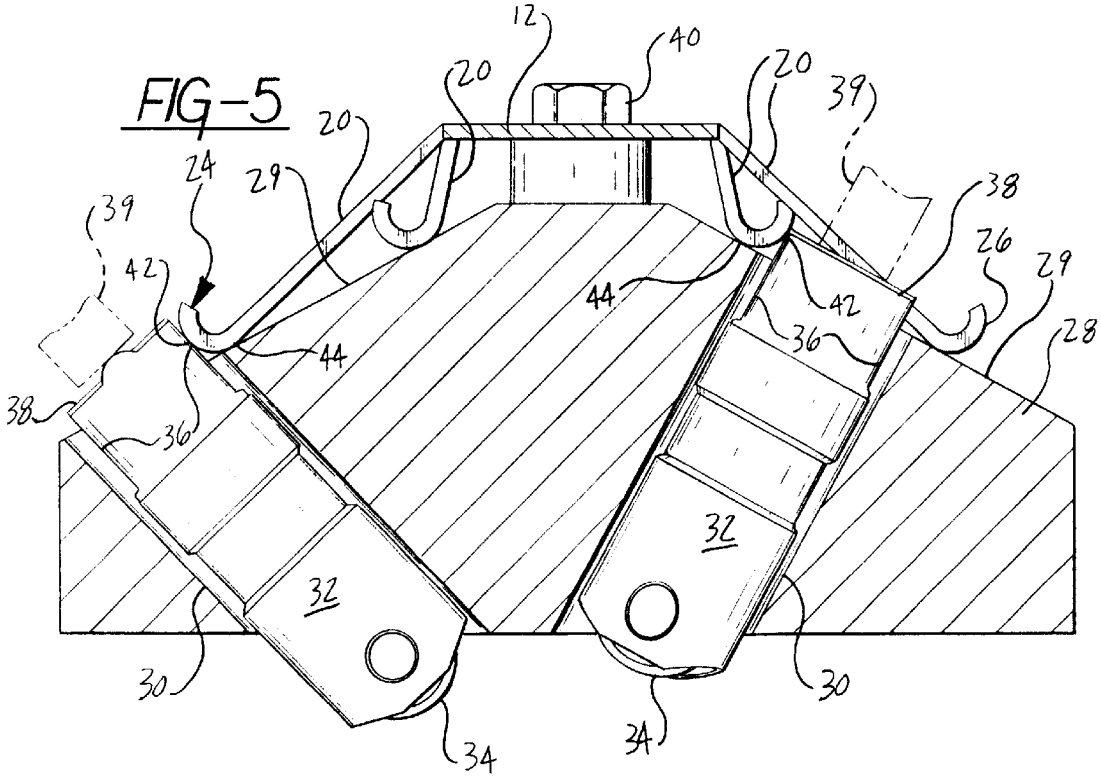
FIG. 5 is an elevational sectional view of internal combustion engine structure illustrating a portion of an engine block having valve lifters located therein, and the guide of FIGS. 1–4 engaging the valve lifter orientation surfaces.

The valve lifter guide 10 is mounted upon an internal combustion engine block 28 as shown in FIG. 5. The engine block 28 is of the V-type having a bank of cylinders formed on each side of the central axis of the engine. Such engines usually include three or four cylinders in a bank, and in the embodiment of the guide shown in FIGS. 1–5 as there are eight fingers 20 defined upon each body lateral side 14, and as two valve guide fingers are associated with each cylinder, the illustrated valve guide is for use with a V-8 engine.

The engine block 28, FIG. 5, includes a flat engine surface 29, and a plurality of valve lifter guide bores 30 are formed in the engine block 28 intersecting the engine surface 29. A roller valve lifter 32 is reciprocally located within each bore 30, and at their lower ends, the valve lifters include rollers 34 which engage the engine camshaft as to be raised and lowered by the camshaft lobes. In FIG. 5, the camshaft is not illustrated.

At their upper ends, the valve lifters 32 are provided with a pair of flat orientation surfaces 36 formed upon opposite sides of the valve lifter. The surfaces 36 are parallel to each other, and intersect the valve lifter upper end 38 which engages the valve lifter rods 39 shown in FIG. 5 in dotted lines. The construction of the valve lifters is shown in greater detail in the applicant's U.S. Pat. No. 5,088,455.

The valve lifter guide 10 is mounted upon the engine block 28 by bolts 40, FIG. 5, which extend through holes 18 and the cantilever supported fingers 20 will be associated with the valve lifters 32 as shown in FIG. 5. In this relationship, the finger convex surfaces 26 will engage a valve lifter orientation surface 36 producing a linear line of contact at 42 across the entire width of the finger. Also, the finger J-shaped convex surface 26 will engage the engine surface 29 at a linear contact line 44. The length of the fingers 20 is such that the fingers are now slightly resiliently flexed. In FIG. 5, it is to be appreciated that the long finger 20 on the right, and the short finger 20 on the left, will also be engaging valve lifters, but the valve lifters have been omitted for purpose of clarity of illustration.

Because the convex surfaces 26 of the fingers engage the flat orientation surfaces 36 of the valve lifters in a linear manner throughout the width of the fingers, the engagement of the fingers and valve lifters at line of contact 42 prevents rotation of the valve lifters about their longitudinal axes.

Figure 7:
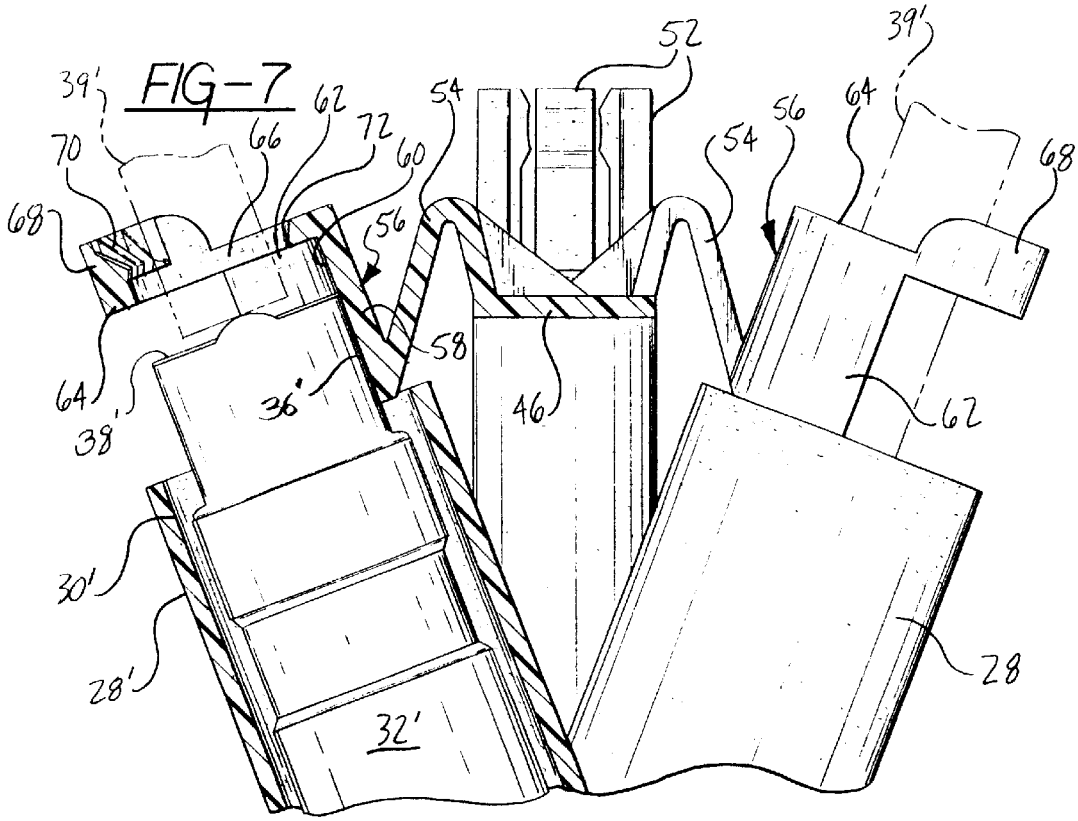
FIG. 7 is a detail sectional view taken along Section 7—7 of FIG. 6.
Figure 6:
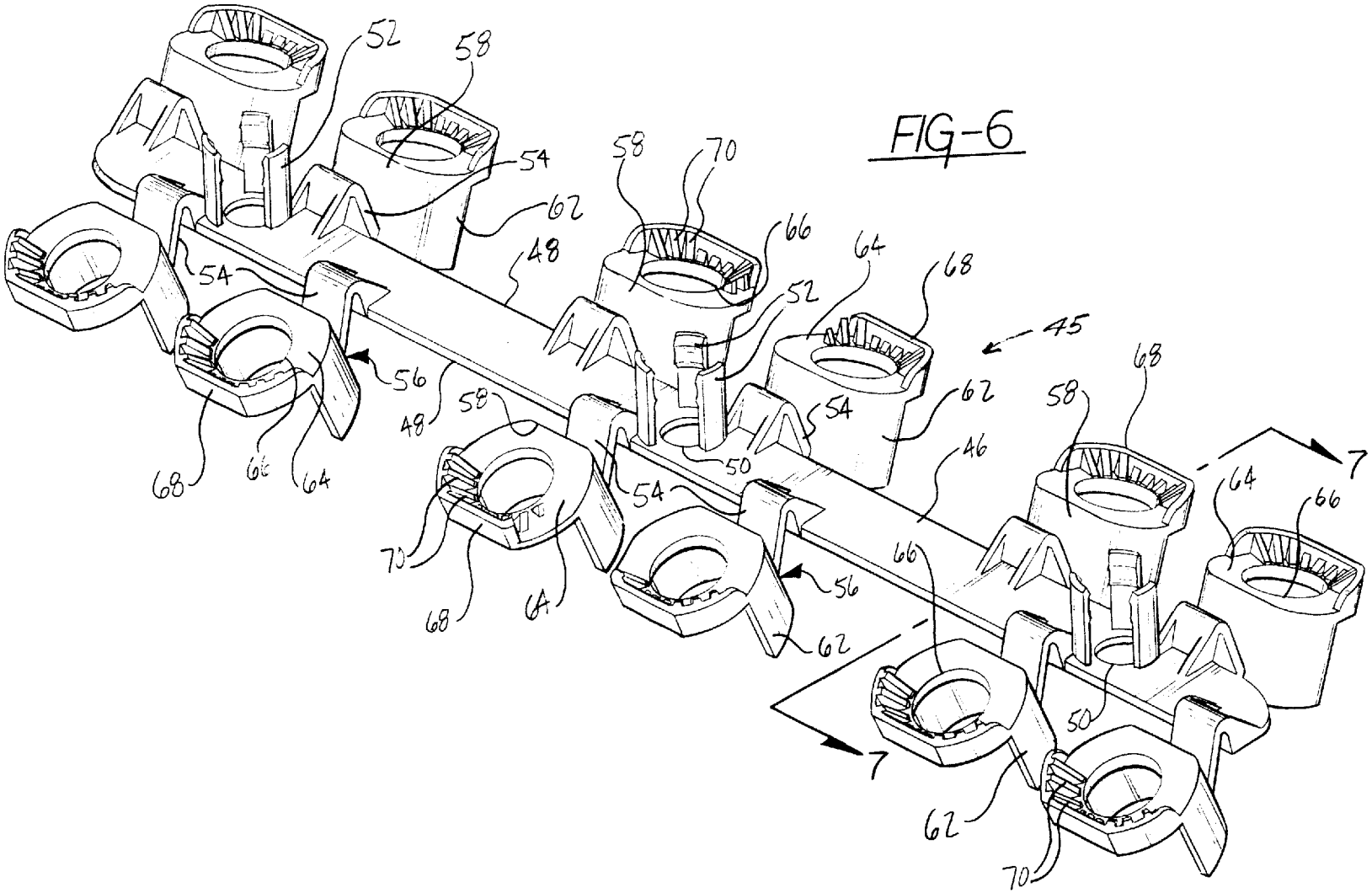
FIG. 6 is a perspective view of an embodiment of valve lifter guide utilizing the inventive concepts wherein a valve push rod guide is located upon the guide fingers.

A variation in a valve lifter guide incorporating the inventive concepts is shown in FIGS. 6 and 7. The valve guide shown in FIGS. 6 and 7 is preferably formed of a moldable polymer by injection molding in that the configuration of the components of the valve lifter are more complex than those shown in the embodiment of FIGS. 1–5.

With respect to FIGS. 6 and 7, the valve lifter guide 45 includes a generally flat central body 46 having parallel lateral sides 48. Holes 50 are defined through the body 46 to permit the guide 45 to be mounted upon an internal combustion engine, and the holes 50 may have guide members 52 located about the holes arising from the central body to facilitate installation of the guide attachment bolts.

A plurality of resilient cantilever supported fingers 54 are defined upon each lateral side 48. In the illustrated embodiment, FIG. 6, six fingers are mounted upon each body lateral side in that guide 45 is used with a V-6 internal combustion engine. Each of the fingers 54 includes a free end 56 having a flat plate 58 defined thereon having a flat inner surface 60, FIG. 7.

As will be appreciated from FIGS. 6 and 7, the plates 58 include aprons 62 homogeneously extending from the edges of the plates 58, and together, the plate 58 and the pair of aprons 62 defined upon each finger end 56, support a rod guide plate 64. The rod guide plate 64 includes a central circular opening 66. The rod guide plates 64 each include an upstanding rise 68 upon which a plurality of oblique chute elements 70 are defined. As will be appreciated from the drawings, the chutes 70 are obliquely disposed to the adjacent opening 66, and in a similar manner, the edge of the opening 66 is obliquely formed at 72, FIG. 7.

In use, the guide 45 is mounted upon an engine block in the manner shown in FIG. 5 wherein bolts 40 will extend through holes 50. The length of the fingers 54 is such that the fingers will cooperate with the engine valve lifters to prevent valve lifter rotation. In this respect, components identical to those previously described are represented by primed reference numerals.

With reference to FIG. 7, the fingers 54 are of such length that the inside surface 60 of the plates 58 will engage a valve lifter orientation surface 36'. This engagement between the orientation surface 36' and the flat surface 60 will prevent valve lifter rotation. Further, the aprons 62 are formed as to conform with the non-flattened portion of the upper ends of the valve lifters accurately positioning the finger ends 56 with respect to the associated valve lifter. Once the guide 45 is fully installed on the internal combustion engine, the guide plate opening 66 will be concentrically positioned relative to the axis of the valve lifter, and the valve lifter rods 39' can be quickly inserted through the guide plate openings 66 for engagement with the upper end 38' of the valve lifters 32'. When inserting the valve lifter rods 39' through the openings 66, the oblique chutes 70 and the opening edge 72 will tend to center the valve lifter rod with the opening 66 facilitating assembly of the valve lifter rods with the valve lifters.

The valve lifter guides herein disclosed may be used with internal combustion engines which do not readily accommodate the valve lifter guide shown in U.S. Pat. No. 5,088,455, and the simple construction of the embodiment of FIGS. 1–5 permit a valve lifter guide to be manufactured at a reduced cost capable of efficiently preventing valve lifter rotation. In the disclosed embodiments, bolts, such as at 40, are used to maintain the valve lifter guides in position on the engine block. It is possible that other retainers could be used to maintain the guides in position such as resilient extensions, metal springs, or other fasteners which will firmly maintain the guides on the engine block. It is to be appreciated that the concept of the valve guides of the invention may be used with either straight or non-V-block engines even though the most desirable application for the invention is with V-block engines.

It is appreciated that various modifications to the inventive concepts may be apparent to those skilled in the art without departing from the spirit and scope of the invention.

What is claimed is:

1. A valve lifter guide for preventing rotation of a plurality of reciprocating valve lifters within an internal combustion engine block operating valve lifter rods wherein the valve lifters each include a flat orientation surface comprising, in combination, an elongated support adapted to be affixed to the engine block, a plurality of resilient cantilevered fingers mounted on said support and extending therefrom, each of said fingers having a free end defining a linear valve lifter orientation surface engagement surface adapted to engage a valve lifter orientation surface, the length of said fingers being such that said fingers are slightly resiliently flexed to maintain engagement of said finger linear surface and the valve lifter orientation surface to prevent rotation of the engaged valve lifter, and engine block mounting means defined on said elongated support.

2. In a valve lifter guide as in claim 1, said elongated support having lateral edges, said cantilevered fingers extending from said lateral edges and being homogeneously formed of the material of said support.

3. In a valve lifter guide as in claim 2, said fingers extending from a common support lateral edge being spaced from each other.

4. In a valve lifter guide as in claim 2, said fingers' free ends being of a linear convex configuration having an outer side, said outer side defining said valve lifter engagement surface.

5. In a valve lifter guide as in claim 4, the engine block including a block surface adjacent the valve lifters, said fingers' free end convex configuration simultaneously engaging a valve lifter flat orientation surface and the adjacent block surface.

6. In a valve lifter guide as in claim 2, said fingers' free ends defining a flat linear valve lifter orientation surface engagement surface partially defining a valve lifter rod guide, said valve lifter rod guide extending over the associated valve lifter and including an opening for receiving a valve lifter rod.

7. In a valve lifter guide as in claim 6, said valve lifter rod guide having an upper surface, valve lifter rod alignment means defined on said upper surface adjacent said opening adapted to align a valve lifter rod with said opening during installation of the valve lifter rods.

8. In a valve lifter guide as in claim 7, said valve lifter rod alignment means comprising oblique surfaces defined on said upper surface of said valve lifter guide extending toward said opening.

* * * * *